United States Patent [19]

Farage

[11] 4,154,679

[45] May 15, 1979

[54] OPERATING MECHANISM FOR SWIMMING POOL SKIMMER

[76] Inventor: Fred Farage, 1002 E. Northern, Phoenix, Ariz. 85020

[21] Appl. No.: 853,215

[22] Filed: Nov. 21, 1977

[51] Int. Cl.[2] ..... E04H 3/20

[52] U.S. Cl. ..... 210/121; 4/172.17; 210/169; 210/407; 210/416 R; 210/459

[58] Field of Search ..... 4/172, 172.17, 172.18; 210/169, 121, 136, 137, 407, 416 R, 459

[56] References Cited

U.S. PATENT DOCUMENTS

| | | | |
|---|---|---|---|
| 2,980,256 | 4/1961 | Nash | 210/169 |
| 3,252,576 | 5/1966 | Miller | 210/169 X |
| 3,306,448 | 2/1967 | Baker | 210/169 X |
| 3,443,264 | 5/1969 | Miller | 210/169 X |
| 3,508,661 | 4/1970 | Diemond et al. | 210/169 |
| 3,628,664 | 12/1971 | Stanwood | 210/169 |
| 3,701,427 | 10/1972 | Howard | 210/169 |
| 3,706,379 | 12/1972 | Erlich | 210/169 |

FOREIGN PATENT DOCUMENTS 2211907 9/1973 Fed. Rep. of Germany ..... 210/169

*Primary Examiner*—Robert H. Spitzer

*Attorney, Agent, or Firm*—Don J. Flickinger; John A. Robertson

[57] ABSTRACT

A divider plate having a strainer basket depending therefrom is positioned in a skimmer apparatus intermediate the skimming inlet and the lower end. A conduit passes through the basket and communicates with the drain inlet in the bottom of the skimmer which also includes an outlet from which water is drawn by the swimming pool pump. The conduit is aligned with a water passage in the divider plate. A coupling member affixed to the hose associated with vacuum cleaning equipment is passed through the water passage and engaged with the conduit. The coupling blocks water flow from the drain inlet and has an exit therethrough for movement of water from the hose to the outlet of the skimmer. Valve means are provided for selectively closing the water passage and for selectively retarding water flow from the drain inlet.

6 Claims, 16 Drawing Figures

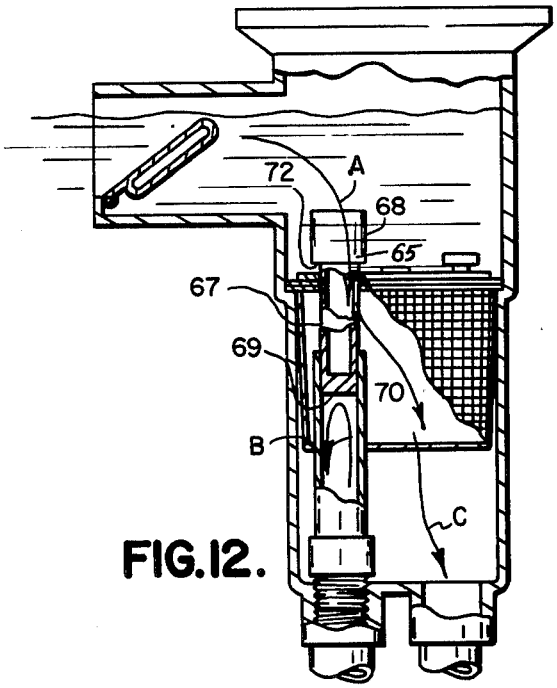
FIG.12.
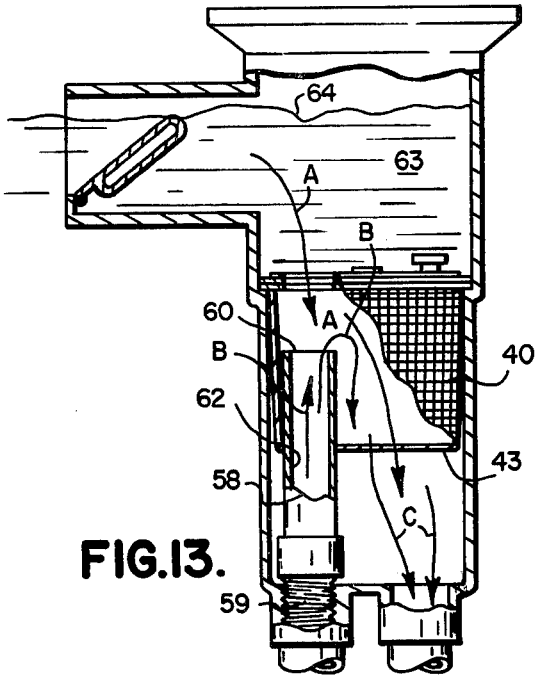
FIG.13.
FIG.15.
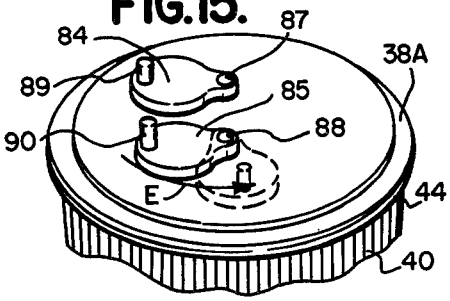
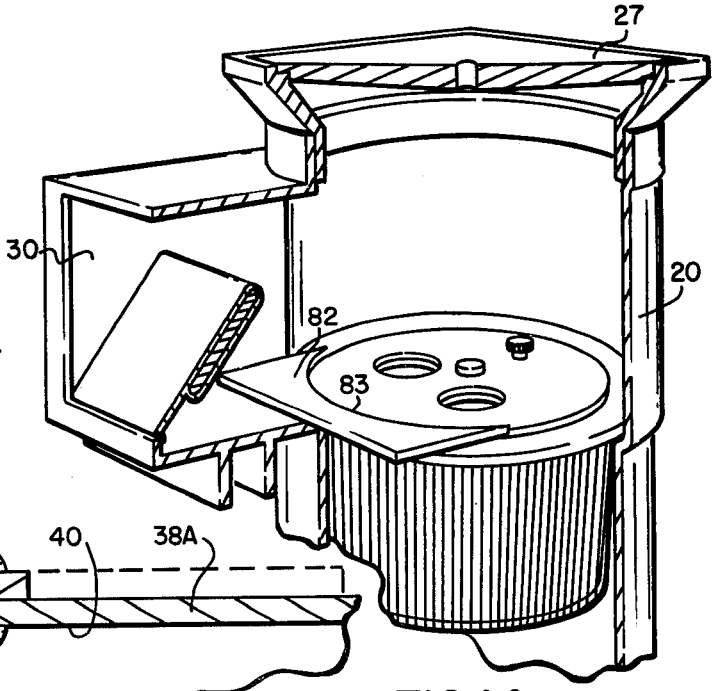
FIG.14.
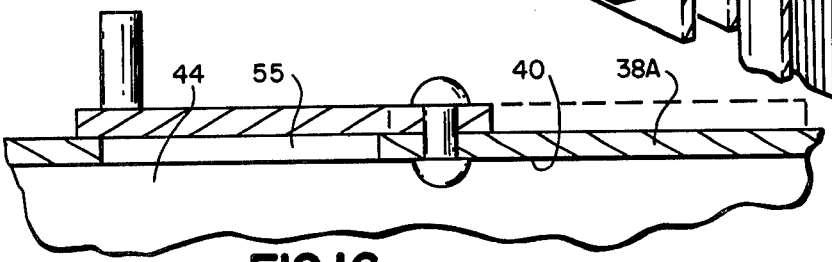
FIG.16.

OPERATING MECHANISM FOR SWIMMING POOL SKIMMER

This invention relates to skimmer apparatus for swimming pools.

More particularly, the present invention relates to an operating mechanism for use in swimming pool skimmers.

In a further aspect, the instant invention concerns an improved operating mechanism for controlling water flow through a skimmer and for attachment of vacuum pool cleaning equipment.

Swimming pools commonly include a device known as a skimmer, the construction and function of which are well known. Briefly, a conventional skimmer includes a hollow housing having a lateral (skimming) inlet which is placed at the normal water level of the pool. Within the device is an inlet which receives water from the main pool drain. Also located within the device is an outlet which communicates with the vacuum side of a water recirculating pump.

A skimmer has primary utility as a pool cleaner, especially removing larger suspended particles. Water and floating debris enter through the skimming inlet and, in response to the vacuum of the pump, is drawn through a strainer basket. Frequently, a floating weir is associated with the skimming inlet to control water surge. The basket is periodically removed for cleaning.

The prior art is replete with various operating mechanisms which have been devised to control water flow through the skimmer. Generally, the mechanism provides selective controls regulating flow between the pump and the skimming inlet and between the pump outlet and the drain inlet. Commonly, the rate of flow is progressively controllable. Attachment means for vacuum cleaning equipment may also be provided.

Until the advent of the instant invention, operating mechanisms for swimming pool skimmers have been unduly complex. In some types, only one flow channel could operate at a given time. Progressive flows required the manipulation of several valves. The temporary attachment of vacuum cleaning equipment usually required special adaptors, particular valve settings or interim modification of the skimmer; all of which caused inconvenience to the pool attendant and inhibited proper use of the operating mechanism.

Accordingly, it is an object of the present invention to provide an improved operating mechanism for use in swimming pool skimmers.

Another object of the invention is the provision of an operating mechanism which is adapted for use in especially constructed skimmers, or pre-existing conventional skimmers.

And, another object of the invention is to provide an operating mechanism having a strainer for intercepting water flow from the skimming inlet and the drain inlet to the pump outlet.

Another object of the present invention is the provision of an operating mechanism which can regulate the water flow through the skimming inlet and the drain outlet.

Still another object of the invention is to provide an operating mechanism having simplified controls for regulating water flow through the skimmer.

A further object of the instant invention is the provision of an operating mechanism to which vacuum cleaning equipment is conveniently attached.

And, a further object of the invention is to provide an operating mechanism which will receive vacuum cleaning equipment without special adaptors, manipulation of multiple valves or temporary modification of the skimmer or the operating mechanism.

Still a further object of this invention is the provision of an operating mechanism which will automatically strain water received from the vacuum cleaning equipment.

Yet a further object of the invention is to provide an operating mechanism in which the entire device, or selected parts thereof, are readily removable from the skimmer for periodic cleaning or servicing.

And still a further object of the instant invention is the provision of an operating mechanism of the above type which is durably constructed, yet relative inexpensively manufactured.

Briefly, to achieve the desired objects of the instant invention, in accordance with a preferred embodiment thereof, first provided is a divider plate which is placed within the skimmer housing intermediate the skimmer inlet and the lower end. It is understood that, in the conventional skimmer, the inlet which communicates with the main drain from the pool and the outlet which communicates with the vacuum side of the recirculating pump reside proximate the lower end of the skimmer housing. A strainer basket depends from the divider plate.

A conduit, having an upper end and a lower end, extends through the basket in axial alignment with a water passage which extends through the divider plate. The lower end of the conduit communicates with the drain inlet. The upper end of the conduit terminates below the divider plate within the strainer basket. A coupling member secured to the hose of conventional vacuum cleaning equipment is received through the water passage and engaged with the upper end of the conduit. The coupling member has a closed lower end which retards water flow from the drain inlet. A water exit extends through the coupling intermediate the divider plate and the upper end of the conduit for water flow between the hose and the pump outlet.

In a further embodiment, valve means are provided for selectively closing the water passage. The valve means may take the form of a valve plate which is in juxtaposition with the top of the divider plate and is pivotally secured thereto. The valve plate includes an aperture which is selectively aligned with the water passage in response to rotation of the valve plate.

The foregoing and further and more specific objects and advantages of the instant invention will become readily apparent to those skilled in the art from the following detailed description of preferred embodiments thereof taken in conjunction with the drawings in which:

FIG. 12 is a vertical sectional view taken along the line 12—12 of FIG. 3;

FIG. 13 is a vertical sectional view taken along the line 13—13 of FIG. 1;

FIG. 14 is an enlarged broken perspective view of a conventional swimming pool skimmer and incorporating an alternate embodiment of an operating mechanism of the instant invention;

FIG. 15 is a partial perspective view of a further alternate operating mechanism embodying the principles of the instant invention; and FIG. 16 is an enlarged fragmentary vertical sectional view taken along the line 16—16 of FIG. 15.

Figure 1:
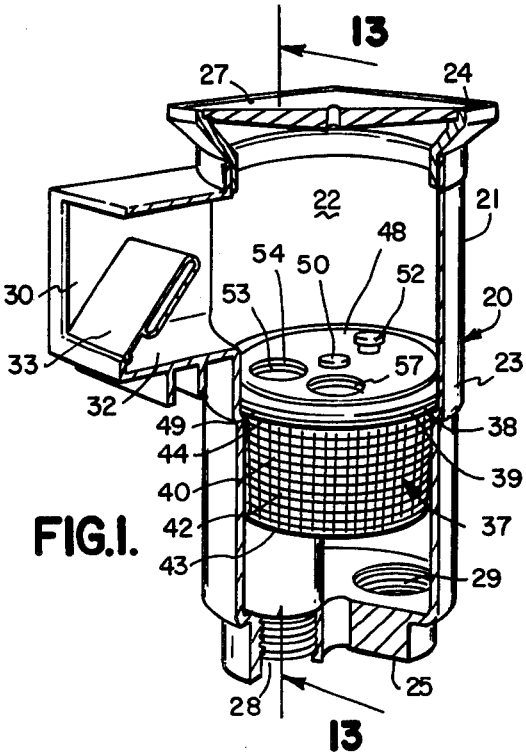
FIG. 1 is a cutaway perspective view of a conventional swimming pool skimmer, including an operating mechanism constructed in accordance with the teachings of the instant invention, the operating mechanism being set to the combination skim and drain position.

Turning now to the drawings, in which like reference characters indicate corresponding elements throughout the several views, attention is first directed to FIG. 1, which shows a conventional swimming pool skimmer generally designated by the reference character 20. The specific configuration of a swimming pool skimmer is determined by the manufacture. In general, skimmers are similar, having analogous components. For purposes of context and reference, the operating mechanism of the instant invention is illustrated in combination with Skimmer Model No. SP-1082, Hayward Manufacturing Company, Inc., 900 Fairmont Ave., Elizabeth, N.J., 07207. The immediate skimmer is considered to be generally representative of the art.

Skimmer 20 includes a hollow housing 21 having inner surface 22, outer surface 23 and upper and lower ends 24 and 25, respectively. Upper end 24 is open and normally closed by cover plate 27. Lower end 25 is closed and has apertures 28 and 29 therethrough, which apertures include female pipe threads. A pipe is normally secured to aperture 28 and communicates with the main drain of the swimming pool. The pipe engaged with threaded aperture 29 communicates with the vacuum side of the recirculating pump normally associated with swimming pools. Accordingly, in the instant text, aperture 28 is referred to as the drain inlet and aperture 29 is referred to as the pump outlet.

A skimming inlet 30 extends through housing 20 intermediate upper and lower ends 24 and 25. Skimmer 20 is normally placed such that skimming inlet 30 is positioned at the normal water level of the swimming pool. Surface water and floating debris enter through skimming inlet 30 and are drawn through pump outlet 29. Normally, a strainer basket resides within housing 21 and intercepts water flow between skimming inlet 30 and drain outlet 29. The top of the basket normally rests flush with the lower surface 32 of skimming inlet 30. A floating weir 33 resides in skimming inlet 30 to control water undulations and surge as will be appreciated by those skilled in the art.

The immediate embodiment of the operating mechanism of the instant invention, shown in FIG. 1 and generally designated by the reference character 37, includes a divider plate 38 which rests upon edge 39 formed in interior surface 20, of housing 21, at a position spaced below lower surface 32 of skimming inlet 30. The specific skimmer illustrated, as supplied by the manufacture, has a ledge which is substantially flush with lower surface 32. The device of the instant invention may be used in connection with the normal shelf. However, it is recommended that a lower ledge be provided, creating a space between divider plate 39 and lower surface 32 for holding a reserve supply of water during undulations, thereby eliminating the necessity of floating weir 33. Divider plate 38 is sealingly engaged with ledge 39. Within the instant application, the term "sealingly engaged" or equivalent phrases is understood to mean substantially retarding water flow which is sufficient for adequate function of the instant device.

Figure 6:
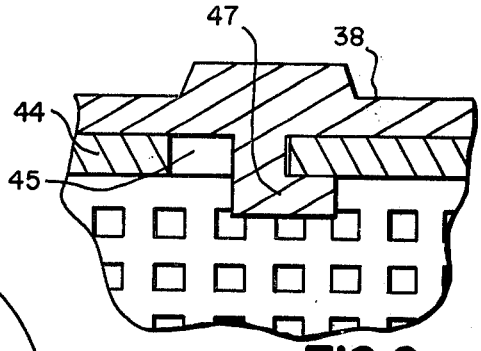
FIG. 6 is an enlarged fragmentary vertical sectional view taken along the line 6—6 of FIG. 5.

A strainer basket 40, having the usual side and bottom sections, 42 and 43, respectively, depends from divider plate 38. In accordance with a preferred embodiment of the invention, as more specifically seen in FIG. 6, strainer basket 40 has an annular rim 44 at the upper edge thereof. Periodically spaced slots 45 extend through rim 44. Hook shaped members 47 depend from divider plate 38 and are numbered, sized and spaced to be received through respective slots 45. Rotation of basket 40 relative divider plate 38 affects engagement between hook shaped members 47 and rim 44. In an alternate embodiment of the invention, rim 44 may be sized to rest upon ledge 39 and divider plate 38 resting upon rim 49 without mechanical engagement therebetween.

A valve plate 48 rests in juxtaposition upon the upper surface 49 of divider plate 38, and is pivotally secured thereto by pin 50. Handle 52 extends upwardly from valve plate 48 and affords a finger grip for rotatably manipulating valve plate 48.

A first water passage 53 extends through divider plate 38 and has a corresponding aperture 54 through valve plate 48. Similarly, a second water passage 55 extends through divider plate 38 and has a corresponding aperture 57 extending through valve plate 48. Preferably, water passages 53 and 55 are of equal size and circumferentially spaced. Apertures 54 and 57 are also of an equal size which is the same as the size of water passages 53 and 55. Further, the spacing between apertures 54 and 57 is equal to the spacing between water passages 53 and 55. The significance of the relationship between the spacing and sizes of water passages 53 and 55 and apertures 54 and 57 will become clear as the description ensues.

With further reference to FIG. 13, there is seen a conduit 58 having a threaded lower end 59 which is engaged with the drain inlet. Conduit 58 also has an open upper end 60 which is intermediate divider plate 38 and bottom section 43 of strainer basket 40. Conduit 58 is closely received through aperture 62 in bottom section 43 to prevent debris within basket 40 from falling toward the bottom 25 of housing 20 and passage through pump inlet 29. Drain inlet 28, aperture 62, water passage 53 and conduit 58 are in substantial axial alignment.

Operating mechanism 37 is readily and conveniently installed through open top 24 of skimmer 20 after removal of cover plate 27. Conduit 58 is first engaged with drain inlet 28. Thereafter, basket 40, with cover plate 38 and valve plate 48 attached thereto, is lowered into housing 21 with aperture 62 being oriented to receive conduit 58. Due to the engagement between hook shaped members 47 and rim 44, water passage 53 is held in alignment with conduit 58. Subsequently, cover plate 27 is replaced. Cover plate 27 generally rests in place and is not mechanically secured. Therefore, it will be appreciated that cover plate 27 is quickly removed for withdrawal and cleaning of basket 40.

Figure 7:
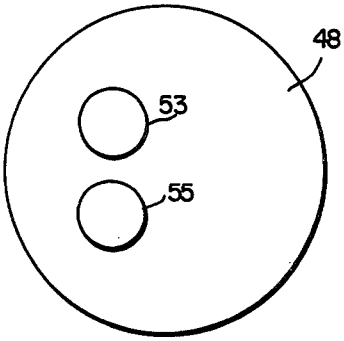
FIG. 7 is a semi-schematic top plan view of the operating mechanism corresponding to the setting as shown in FIG. 1.

A function of operating mechanism 37 is the control of water flow through skimmer 20. FIGS. 1, 7 and 13 illustrate operating mechanism 37 set to the combination skim and drain position. Apertures 54 and 57 are aligned with water passages 53 and 55, respectively. Swimming pool water 63, having surface 64, extends into housing 21 above divider plate 38. It is noted, especially in FIGS. 13, that only the surface layer of water and floating debris passes through skimming inlet 30 over floating weir 33. In response to the vacuum created by the recirculating pump at pump inlet 29, pool water passes through apertures 54 and 57 and water passages 53 and 55, as indicated by arrows A. As indicated by arrows B, water is also drawn through conduit 58 from drain inlet 28. Subsequently, the water passes through strainer basket 40 and enters pump inlet 29, as indicated by arrows C for routing through the swimming pool recirculation system, which may include a filter for removal of fine particles.

Figure 2:
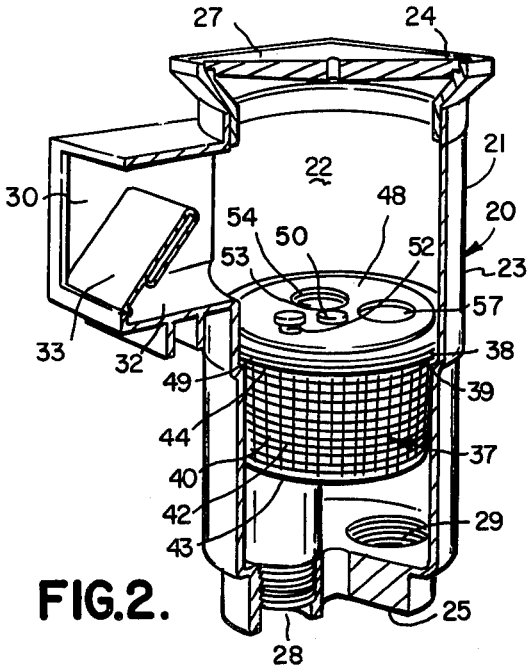
FIG. 2 is a view generally corresponding to the view of FIG. 1 and illustrating the operating mechanism set in the full drain position.
Figure 8:
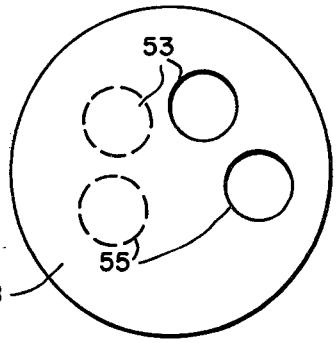
FIG. 8 is a semi-schematic top plan view corresponding to the operating mechanism as illustrated in FIG. 2.

The full drain position is illustrated in FIGS. 2 and 8. Apertures 54 and 57 reside over a solid portion of divider plate 38. Similarly, a solid portion of valve plate 48 resides over water passages 53 and 55. Accordingly, water passages 53 and 57 are closed, prohibiting the movement of water between skimming inlet 30 and pump inlet 29. A reduced skimming action can be had by rotating valve plate 48 relative divider plate 38 such that either aperture 54 aligns with water passage 55 or aperture 57 aligns with water passage 53. In either case, one-half of the flow area is available to skimmed water as in the combination skim and drain position, as previously described.

Figure 3:
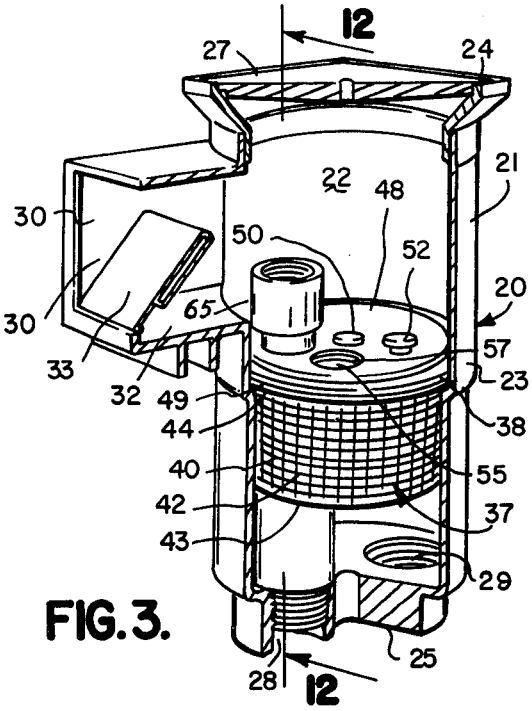
FIG. 3 is a view generally corresponding to the view of FIG. 1 and showing the operating mechanism in the full skim position.
Figure 9:
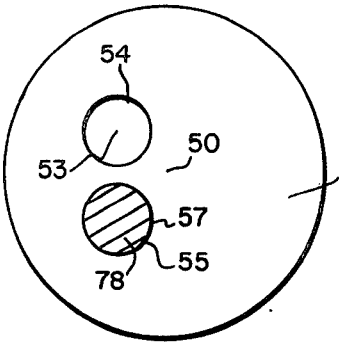
FIG. 9 is a semi-schematic top plan view corresponding to the operating mechanism as represented in FIG. 3.

The full skim position is represented in FIGS. 3, 9 and 12. Valve plate 48 is positioned relative divider plate 38 as illustrated in the combination skim and drain position. A stopper valve 65 is used for this operation. Stopper valve 65 includes a hollow cylindrical body 67 having an open upper end 68 and a closed lower end 69. An opening 70 extends through body 67. Body 67 is sized to be closely received and seal conduit 58. Shoulder 72 rests upon valve plate 48 and limits the downward movement of stopper valve 65, positioning opening 70 within basket 40 above the upper end 60 of conduit 58 and below divider plate 38. Skimming water, as indicated by arrow A, moves through body 67, entering open end 68 and exiting opening 70. The water passes through basket 40 and enters pump inlet 29, as indicated by arow C. As seen by arrow B, water from drain inlet 28 is retarded from entering housing 21 or flowing to pump outlet 29. Skimming water also moves in the direction of arrows A and C through opening 57 and water passage 55. For limited skimming action, valve plate 48 is rotated, aligning aperture 57 with water passage 53, prior to the insertion of stopper valve 67.

Figure 4:
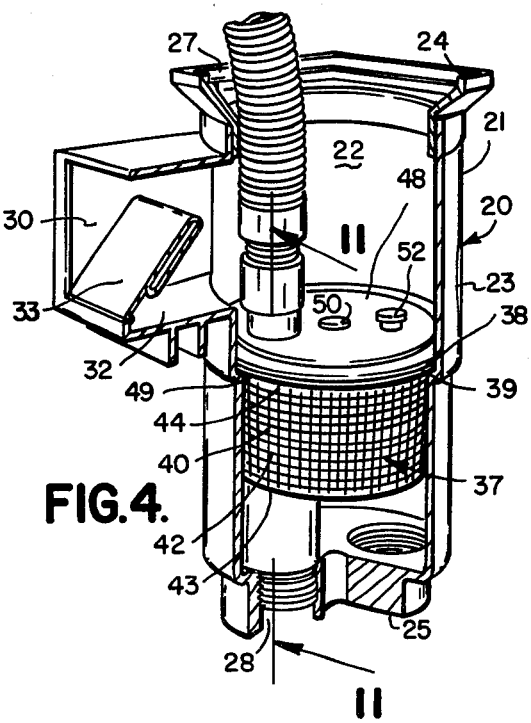
FIG. 4 is a view generally corresponding to the view of FIG. 1 and showing the operating mechanism in the combined vacuum and skim position.
Figure 10:
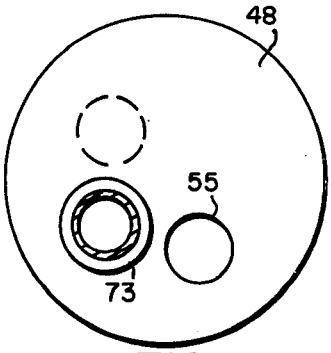
FIG. 10 is a semi-schematic top plan view of the operating mechanism adjusted to the position depicted in FIG. 4.
Figure 5:
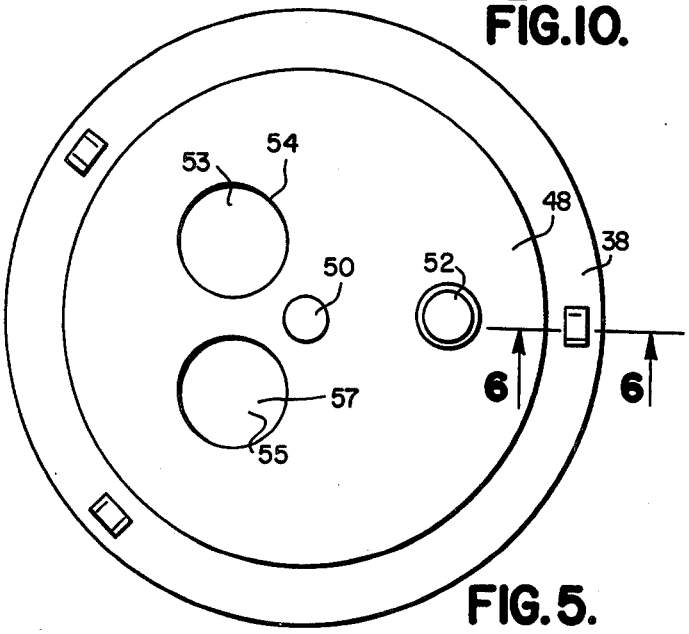
FIG. 5 is an enlarged top plan view of the operating mechanism of FIGS. 1–4.
Figure 11:
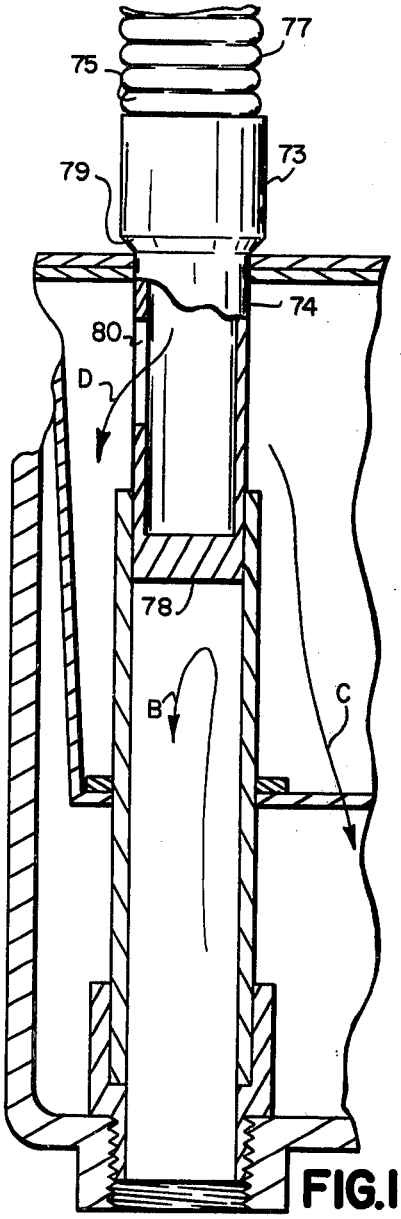
FIG. 11 is an enlarged vertical sectional view taken along the line 11—11 of FIG. 4.

Another function of operating mechanism 37 is the operative attachment of conventional vacuum equipment, as commonly applied for cleaning swimming pools. The use of vacuum cleaning equipment is described in connection with FIGS. 4, 10 and 11. A coupling member 73 includes a hollow cylindrical body 74 having a open upper end 75 which is engaged with the conventional hose 77 normally associated with vacuum cleaning equipment. Similar to stopper valve 65, coupling member 73 is sized to be received within conduit 58 and includes a closed lower end 78, a shoulder 79 and lateral opening 80. Aperture 57 is aligned with water passage 53 prior to insertion of coupling member 73. Shoulder 79 abuts valve plate 48, limiting the downward movement of coupling member 73 and positioning lateral opening 80 above conduit 58 and below divider plate 38. Water movement from drain inlet 28 is retarded as illustrated by arrow B. In response to the vacuum of the recirculating pump, water is drawn through the vacuum cleaning equipment, including hose 77 and lateral opening 80, in the direction of arrow D and subsequently through basket 40 in the direction of arrow C toward pump outlet 29. A lesser vacuum within hose 77 can be had by aligning valve plate 48 relative divider plate 38 as seen in FIG. 1 prior to insertion of coupling 73.

FIG. 14 illustrates an alternate embodiment of the invention including an alignment member 82 projecting radially from divider plate 38. Alignment member 82 is sized to be received within skimming inlet 30 and rests upon lower surface 32 and has an arcuate inner edge 83 which accomodates valve plate 48. Alignment member 82 positions divider plate 38 relative housing 28 such that water passage 53 is held in axial alignment with drain inlet 28. Basket 40 is aligned as aperture 62 is passed over conduit 58. Alignment member 82 eliminates the necessity of flots 45 and hook shaped members 47, as previously described in connection with FIG. 6.

FIGS. 15 and 16 illustrate yet another alternate embodiment of the instant invention having a modified divider plate **38*a* which rests upon rim 44 of strainer basket 40. Individual valve plates 84 and 85 are pivotally secured to divider plate 38*a* by pivot pins 87 and 88, respectively. Valve plates 84 and 85 also include operating handles 89 and 90, respectively. Valve plate 84 is positioned to close water passage 53, and valve plate 85 is positioned to close water passage 55. Water passage 53 is not seen in the immediate illustrations. However, it is understood that water passage 53 extends through divider plate 38*a*** as shown in previous illustrations.

Valve plate 85 is moveable between a first position in which water passage is closed, as shown in the solid outline of FIG. 15, and a second position, as seen by the broken outline in which passage 55 is open. During movement between the two positions, valve plate 85 moves in an arcuate path, as seen by the arrowed line E. Valve plate 84 similarly moves in an arcuate path about pivot pin 87 between first and second positions. The function and operation of the immediate embodiment is analogous to the operation and function of previously described embodiments with valve plates 84 and 85 being moved to achieve the various combinations of water flow.

Various changes and modifications to the embodiments herein chosen for purposes of illustration will readily occur to those skilled in the art. It is appreciated that the size and arrangement of components will be adapted to fit various skimmers. To the extend that such modifications and variations do not depart from the spirit of the invention, they are intended to be included within the scope thereof, which is limited only by a fair interpretation of the appended claims.

Having fully described the present invention and alternate embodiments thereof in such clear and concise terms as to enable those skilled in the art to understand and practice the same, the invention claimed is:

1. In a swimming pool skimmer apparatus including:
a housing having a lower end and an open upper end,
a skimming inlet through said housing intermediate said ends for receiving water from said pool,
a drain inlet proximate the lower end of said housing for receiving water from said pool, and
an outlet proximate the lower end of said housing communicating with a source of vacuum for discharging water from said housing, an improved operating mechanism for controlling water flow through said skimmer apparatus and for operative connection with the hose of vacuum cleaning equipment, said operating mechanism comprising:

(a) a divider plate sealingly engaging said housing intermediate said skimming inlet and said lower end;
(b) a water passage extending through said divider plate in axial alignment with said drain inlet;
(c) a coupling member sealingly receivable through said water passage and having a closed lower end sealingly engagable within the upper end of said conduit, an open end engagable with the hose of said vacuum cleaning equipment, and a water exit extending through said coupling member intermediate said divider plate and the upper end of said conduit;
(d) a strainer basket depending from said divider plate and having side and bottom sections;
(e) a conduit extending through said basket in axial alignment with said water passage and having a lower end communicating with said drain inlet and an upper end intermediate said divider plate and the bottom section of said basket; and
(f) valve means for selectively closing water passage.

2. The operating mechanism of claim 1, wherein said valve means includes:

(a) a valve plate in juxtaposition with said divider plate; and
(b) pivot means connecting said valve plate to said divider plate for rotary movement relative said divider plate between a first position and a second position,
said passage being open in said first position, and said passage being closed in said second position.

3. The operating mechanism of claim 2, further including an aperture extending through said valve plate and aligning with said water passage when said valve plate is in said first position.

4. The operating mechanism of claim 3, further including:

(a) a second water passage extending through said divider plate and spaced circumferentially from the first said water passage; and
(b) a second aperture extending through said valve plate and circumferentially spaced from the first said aperture a distance equal to the spacing between said water passages.

5. The operating mechanism of claim 4, wherein said valve plate resides above said divider plate and includes a finger grip projecting upwardly therefrom.

6. The operating mechanism of claim 1, further including a stopper valve for selectively retarding water flow from said conduit.

* * * * *